US007018023B2

(12) United States Patent
Shimada

(10) Patent No.: US 7,018,023 B2
(45) Date of Patent: Mar. 28, 2006

(54) LIQUID-JET HEAD, METHOD OF MANUFACTURING THE SAME, AND LIQUID-JET APPARATUS

(75) Inventor: Masato Shimada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 122 days.

(21) Appl. No.: 10/679,515

(22) Filed: Oct. 7, 2003

(65) Prior Publication Data

US 2004/0130601 A1 Jul. 8, 2004

(30) Foreign Application Priority Data

Oct. 8, 2002 (JP) ..... 2002-295340
Aug. 12, 2003 (JP) ..... 2003-292369
Oct. 3, 2003 (JP) ..... 2003-345463

(51) Int. Cl.
*B41J 2/02* (2006.01)

(52) U.S. Cl. ..... 347/71; 347/68; 347/70; 347/72

(58) Field of Classification Search ..... 347/68–72; 29/25.35, 890.1
See application file for complete search history.

(56) References Cited

U.S. PATENT DOCUMENTS 4,605,939 A * 8/1986 Hubbard et al. ..... 347/71
5,880,763 A * 3/1999 Tanaka et al. ..... 347/70

FOREIGN PATENT DOCUMENTS

JP 2000-127379 A 5/2000

* cited by examiner

*Primary Examiner*—Manish Shah
*Assistant Examiner*—Geoffrey S. Mruk
(74) *Attorney, Agent, or Firm*—Sughrue Mion, PLLC

(57) ABSTRACT

Provided are a liquid-jet head in which a passage-forming substrate and a nozzle plate can be suitably joined, a method of manufacturing the same, and a liquid-jet apparatus. A covering plate has a piezoelectric element holding portion which covers piezoelectric elements. This covering plate is joined with a side of the passage-forming substrate where the piezoelectric elements are provided. At the same time, the nozzle plate provided with nozzle orifices is joined with a side of the passage-forming substrate opposite the side where the covering plate is joined. Moreover, at least a region of the passage-forming substrate facing the piezoelectric element holding portion is formed to be relatively thicker than the outside of the region facing the piezoelectric element holding portion.

6 Claims, 8 Drawing Sheets

LIQUID-JET HEAD, METHOD OF MANUFACTURING THE SAME, AND LIQUID-JET APPARATUS

BACKGROUND OF THE INVENTION

1. Field of the Invention

The present invention relates to a liquid-jet head which ejects jets of liquid, a method of manufacturing the same, and a liquid-jet apparatus. Particularly, the present invention relates to an ink-jet recording head, a method of manufacturing the same, and an ink-jet recording apparatus, in which the ink-jet recording head causes nozzle orifices to eject ink droplets by having piezoelectric elements pressurize ink supplied to pressure generating chambers communicating with the nozzle orifices.

2. Description of the Related Art

In an ink-jet recording head, a vibration plate constitutes part of pressure generating chambers communicating with nozzle orifices which eject ink droplets. Piezoelectric elements deform this vibration plate to pressurize ink in the pressure generating chambers, thereby causing the nozzle orifices to eject ink droplets. There are two types of piezoelectric actuators which have been employed by this ink-jet recording head for practical use: a piezoelectric actuator of a longitudinal vibration mode which extends and contracts in an axial direction of the piezoelectric elements, and a piezoelectric actuator of a flexure vibration mode.

A well-known example of the ink-jet recording head employing the actuator of the flexure vibration mode is as follows: a uniform piezoelectric material layer is formed over the entire surface of the vibration plate by deposition technology; this piezoelectric material layer is cut into pieces by use of a lithography method so that the shape thereof becomes suitable for the pressure generating chambers; and the piezoelectric elements are formed independently for the respective pressure generating chambers.

In addition, the following structure is generally employed by the ink-jet recording head. Pressure generating chambers and piezoelectric elements are formed on a passage-forming substrate, and a plate having a piezoelectric element holding portion is joined with the side of this passage-forming substrate where the piezoelectric elements are formed. A nozzle plate provided with nozzle orifices is joined with the side opposite the side where the piezoelectric elements are formed. By sealing the piezoelectric elements in the piezoelectric element holding portion, damage to the piezoelectric elements due to, for example, external environment such as atmospheric vapors is prevented (e.g., refer to Japanese Unexamined Patent Publication No. 2000-127379).

However, in the ink-jet recording head with this structure, the pressure generating chambers and the like are formed while the plate having the piezoelectric element holding portion is joined with the passage-forming substrate. Thereafter, the nozzle plate is joined with the passage-forming substrate. Thus, there is a problem that this is likely to cause connection defects of the nozzle plate. In other words, if the nozzle plate is joined with the passage-forming substrate as being pressured, the passage-forming substrate is deformed toward the piezoelectric element holding portion. Accordingly, a problem arises that the sufficient connection strength cannot be obtained. Note that this problem arises not only in the ink-jet recording head which ejects ink, but also in other liquid-jet heads which eject liquid other than ink.

SUMMARY OF THE INVENTION

In consideration of the foregoing circumstances, an object of the present invention is to provide a liquid-jet head in which the passage-forming substrate and the nozzle plate can be suitably joined, a method of manufacturing the same, and a liquid-jet apparatus.

A first aspect of the present invention achieving the foregoing object is a liquid-jet head including a passage-forming substrate and piezoelectric elements; pressure generating chambers communicating with nozzle orifices which eject liquid are formed on the passage-forming substrate; the piezoelectric elements are provided on one side of the passage-forming substrate through a vibration plate and cause pressure changes in the pressure generating chambers. The liquid-jet head is characterized in that a covering plate having a piezoelectric element holding portion which covers the piezoelectric elements is joined with the side of the passage-forming substrate where the piezoelectric elements are provided; at the same time, a nozzle plate provided with the nozzle orifices is joined with a side of the passage-forming substrate, opposite the side where the covering plate is joined; and at least a region of the passage-forming substrate facing the piezoelectric element holding portion is thicker than an outside of the region facing the piezoelectric element holding portion.

In the first aspect, since the rigidity of the passage-forming substrate in the region facing the piezoelectric element holding portion is higher than that in the vicinity of the edge, it is possible to prevent the passage-forming substrate from deforming toward the piezoelectric element holding portion when the nozzle plate is joined. Thus, the passage-forming substrate and the nozzle plate can be suitably joined.

A second aspect of the present invention is as follows: in the first aspect, the liquid-jet head is characterized in that the region of the passage-forming substrate facing the piezoelectric element holding portion is relatively thicker than the outside of the region facing the piezoelectric element holding portion at least in an aligned direction of the pressure generating chambers.

In the second aspect, by changing the thickness of the passage-forming substrate at least in one direction, the nozzle plate can be suitably joined.

A third aspect of the present invention is as follows: in the first or second aspect, the liquid-jet head is characterized in that the region of the passage-forming substrate facing the piezoelectric element holding portion is relatively thicker than the outside of the region facing the piezoelectric element holding portion at least in a longitudinal direction of the pressure generating chambers.

In the third aspect, by changing the thickness of the passage-forming substrate at least in one direction, the nozzle plate can be suitably joined.

A fourth aspect of the present invention is as follows: in any one of the first to third aspects, the liquid-jet head is characterized in that the thickness of the passage-forming substrate is tapered from the region facing the piezoelectric element holding portion toward the edge of the passage-forming substrate.

In the fourth aspect, since the rigidity of the passage-forming substrate changes gradually, it is possible to prevent the passage-forming substrate from cracking due to a load applied on the passage-forming substrate when joined with the nozzle plate.

A fifth aspect of the present invention is as follows: in any one of the first to fourth aspects, the liquid-jet head is characterized in that a difference between the maximum and minimum thicknesses of the passage-forming substrate is 30 nm to 5 μm.

In the fifth aspect, it is possible to suitably join the passage-forming substrate and the nozzle plate together without degrading ejection characteristics of the liquid.

A sixth aspect of the present invention is a liquid-jet apparatus characterized by including the liquid-jet head in any one of the first to fifth aspects.

In the sixth aspect, it is possible to realize a liquid-jet apparatus the reliability of which is improved.

A seventh aspect of the present invention is a method of manufacturing a liquid-jet head including a passage-forming substrate, piezoelectric elements, a covering plate and a nozzle plate; pressure generating chambers communicating with nozzle orifices which eject liquid are formed on the passage-forming substrate; the piezoelectric elements are provided on one side of the passage-forming substrate through a vibration plate and cause pressure changes in the pressure generating chambers; the covering plate has a piezoelectric element holding portion covering the piezoelectric elements and is joined with the side of the passage-forming substrate where piezoelectric elements are formed; the nozzle plate is provided with the nozzle orifices and joined with a surface of the passage-forming substrate opposite the side where the covering plate is joined. The method of manufacturing the liquid-jet head is characterized by including the steps of: joining the covering plate with the passage-forming substrate on which the piezoelectric elements are formed; grinding or polishing a joint surface of the passage-forming substrate with the nozzle plate with a predetermined load to make the passage-forming substrate have a predetermined thickness and forming the joint surface of the passage-forming substrate with the nozzle plate to be curved to make at least a region of the passage-forming substrate facing the piezoelectric element holding portion relatively thicker than an outside of the region facing the piezoelectric element holding portion; forming the pressure-generating chambers on the passage-forming substrate; and joining the nozzle plate with the passage-forming substrate.

In the seventh aspect, since the rigidity of the passage-forming substrate in the region facing the piezoelectric element holding portion is higher than that in the vicinity of the edge by relatively changing the thickness of the passage-forming substrate, it is possible to prevent the passage-forming substrate from deforming toward the piezoelectric element holding portion when the nozzle plate is joined. Thus, the passage-forming substrate and the nozzle plate can be suitably joined.

An eighth aspect of the present invention is as follows: in the seventh aspect, the method of manufacturing the liquid-jet head is characterized in that, in the step of joining the nozzle plate, a nozzle communication plate on which nozzle communicating holes communicating with the pressure generating chambers and the nozzle orifices are formed is joined with the surface of the passage-forming substrate, and the nozzle plate is joined with the nozzle communicating plate.

In the eighth aspect, by joining the nozzle communicating plate with the passage-forming substrate, it is possible to more securely prevent the deformation of the passage-forming substrate when the nozzle plate is joined.

DESCRIPTION OF THE PREFERRED EMBODIMENTS

The present invention will be described in detail below based on embodiments.

Figure 1:
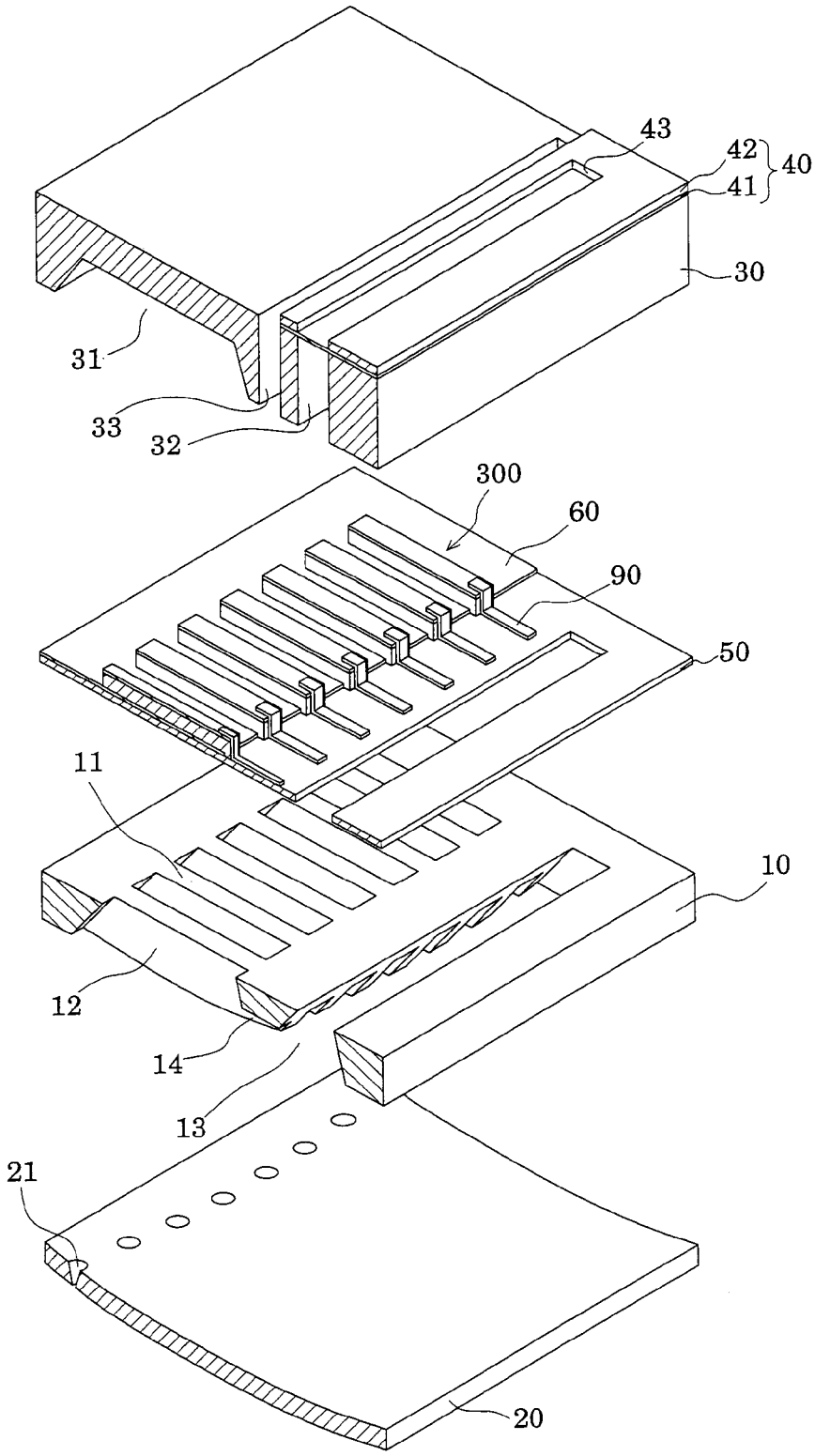
FIG. 1 is an exploded perspective view of a recording head according to Embodiment 1.
Figure 2A:
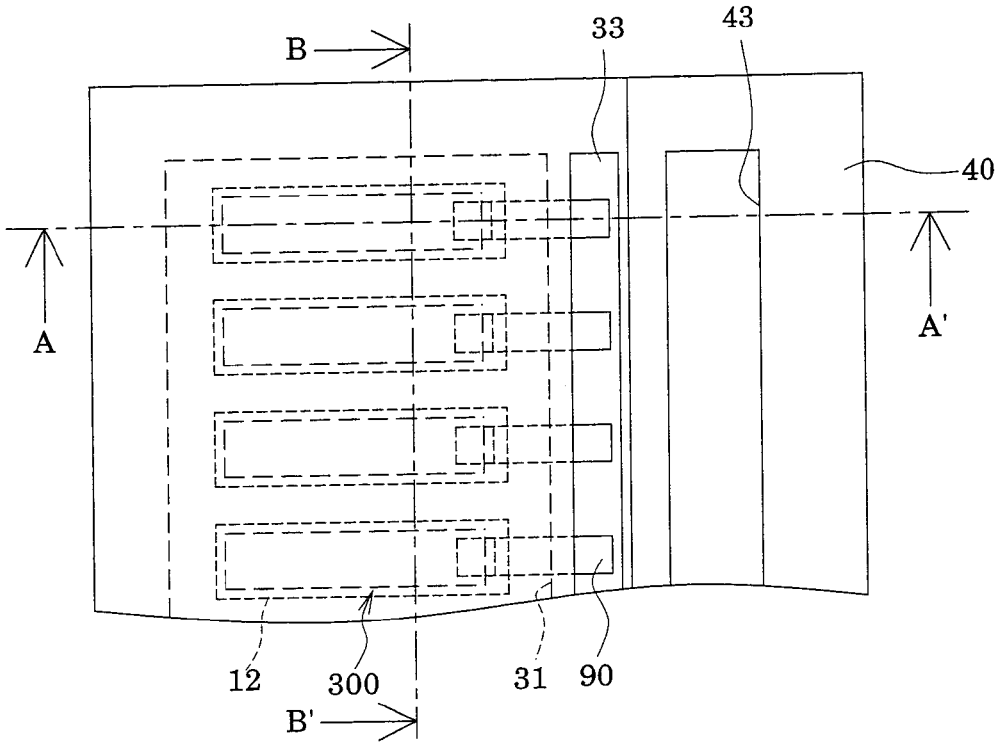
FIG. 2A is a plan view of the recording head according to Embodiment 1.
Figure 2B:
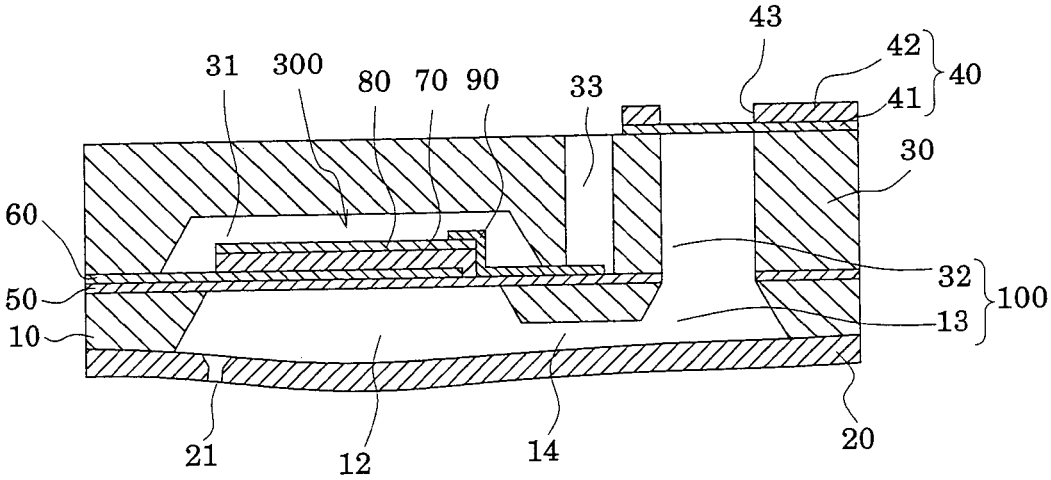
FIG. 2B is a sectional view thereof.
Figure 3:
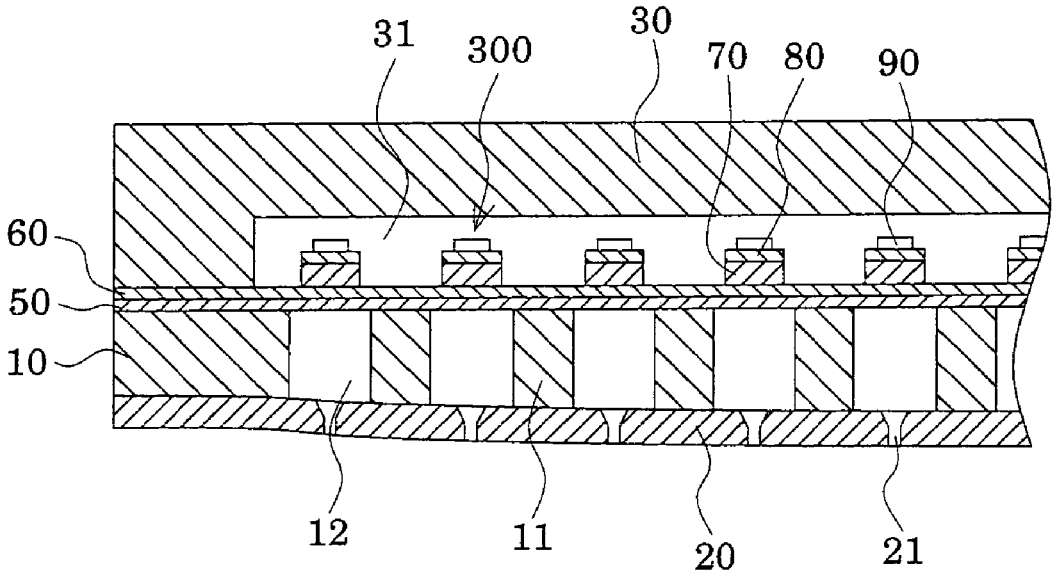
FIG. 3 is a sectional view of the recording head according to Embodiment 1.

FIG. 1 is an exploded perspective view of an ink-jet recording head according to Embodiment 1. FIG. 2A is a schematic plan view of FIG. 1, and FIG. 2B is a sectional view taken along the A–A' line in FIG. 2A. FIG. 3 is a sectional view taken along the B–B' line in FIG. 2A. As shown in the drawings, a passage-forming substrate 10 is made of a single crystal silicon substrate with a plane orientation (110) in the present embodiment, and an elastic film 50 with a thickness of 1 to 2 μm is provided on one side of the passage-forming substrate 10. This elastic film 50 is made of silicon dioxide formed through thermal oxidation in advance.

In the passage-forming substrate 10, pressure generating chambers 12 are aligned in a width direction thereof by performing anisotropic etching from the other side of the passage-forming substrate 10. These pressure generating chambers 12 are sectioned by a plurality of compartment walls 11. In the outside of the pressure generating chambers 12 in a longitudinal direction thereof, a communicating portion 13 is formed to constitute part of a reservoir 100, a common ink chamber for the pressure generating chambers 12. The communicating portion 13 communicates with one set of ends of the pressure generating chambers 12 in the longitudinal direction through respective ink supply paths 14. Moreover, a nozzle plate 20 mentioned below is joined with the side of the passage-forming substrate 10 opposite the side where the elastic film 50 is joined so that the nozzle orifices 21 and the pressure generating chambers 12 communicate. At the same time, this nozzle plate 20 seals the pressure generating chambers 12, the communicating portion 13 and the ink supply paths 14.

Furthermore, a region of the passage-forming substrate 10 facing the piezoelectric element holding portion 31 of a covering plate 30 as hereinafter described is relatively thicker than the outside of the region facing the piezoelectric element holding portion 31. Since the piezoelectric element 300 formed inside the covering plate 30, the piezoelectric element 300 is hardly influenced by the external environment. In terms of the depths of pressure generating chambers 12, the deepest is in a central portion of lines of the aligned pressure generating chambers 12. The depths of the pressure generating chambers 12 become shallower as approaching the edges of the lines. Moreover, in terms of a depth of each pressure generating chamber 12 in the longitudinal direction, a central portion of the pressure generating chamber 12 is the deepest, and the pressure generating chamber 12 becomes shallower as approaching the ends thereof.

Herein, the anisotropic etching is performed utilizing a difference between etching rates of the single crystal silicon substrate. For example, in the present embodiment, the single crystal silicon substrate is dipped in an alkaline solution such as KOH and gradually eroded. Accordingly, a first (111) plane and a second (111) plane appear. The first (111) plane is perpendicular to a (110) plane, and the second (111) plane makes approximately 70 degrees with the first (111) plane and approximately 35 degrees with the foregoing (110) plane. The anisotropic etching is performed utilizing the characteristics that the etching rate of the (111) planes is approximately 1/180 of that of the (110) plane. This anisotropic etching enables high-precision processing based on the depth processing of a parallelogram formed by two first (111) planes and two slanted second (111) planes. Thus, the pressure generating chambers 12 can be aligned with high density.

In the present embodiment, long sides and short sides of each pressure generating chamber 12 are formed by the first (111) planes and the second (111) planes, respectively. These pressure generating chambers 12 are formed by etching the passage-forming substrate 10 so as to substantially penetrate the passage-forming substrate 10 until reaching the elastic film 50. Herein, the area of the elastic film 50 eroded by the alkaline solution, which is used for etching the single crystal silicon substrate, is extremely small. In addition, cross sections of the ink supply paths 14, communicating with the one ends of the respective pressure generating chambers 12, are formed to be smaller than those of the pressure generating chambers 12. Hence, the passage resistance of ink which flows into the pressure generating chambers 12 is constantly maintained.

An optimal thickness for this passage-forming substrate 10 may be selected in accordance with the aligning density of the pressure generating chambers 12. If the aligning density of the pressure generating chambers 12 is, for example, around 180 per inch (180 dpi), the thickness of the passage-forming substrate 10 may be set to approximately 220 μm. However, if the pressure generating chambers 12 are aligned with a relatively high density of 200 dpi or more, it is preferable that the thickness of the passage-forming substrate 10 is relatively thinner, 100 μm or less. This is because the aligning density can be increased while maintaining the rigidity of the compartment walls 11 between the adjacent pressure generating chambers 12.

By the undermentioned process, a lower electrode film 60, a piezoelectric layer 70 and an upper electrode film 80 are stacked on the side of the elastic film 50 opposite an opening surface of the passage-forming substrate 10 to constitute piezoelectric elements 300. The thicknesses of the lower electrode film 60, the piezoelectric layer 70 and the upper electrode film 80 are, for example, approximately 0.2 μm, 1.0 μm and 0.1 μm, respectively. Herein, the piezoelectric elements 300 are portions each of which includes the lower electrode film 60, the piezoelectric layer 70 and the upper electrode film 80. Each piezoelectric element 300 is structured so that any one of the electrodes is set as a common electrode, and the other electrode and the piezoelectric layer 70 are patterned for each pressure generating chamber 12. A portion which includes the patterned electrode and the piezoelectric layer 70, and in which piezoelectric strain occurs by applying voltage to both electrodes is referred to as a piezoelectric active portion. In the present embodiment, the lower electrode film 60 is the common electrode of the piezoelectric elements 300, and the upper electrode film 80 is an individual electrode of each piezoelectric element 300. However, these can be reversed depending on a drive circuit or wiring without causing any trouble. In both cases, the piezoelectric active portion is formed for each pressure generating chamber 12. Moreover, the piezoelectric elements 300 and the vibration plate in which displacement occurs by driving the piezoelectric elements 300 are generically referred to as a piezoelectric actuator. Note that the elastic film 50 and the lower electrode film 60 act as the vibration plate in the above example. Further, lead electrodes 90 are connected to the respective upper electrode films 80, the individual electrodes of the piezoelectric elements 300. The lead electrodes 90 are made of, for example, gold (Au), and one set of ends thereof extend to regions facing the ink supply paths 14.

While securing a space which does not hinder the operation of the piezoelectric elements 300, the covering plate 30 is joined with the passage-forming substrate 10 on which the piezoelectric elements 300 as described above are formed. This covering plate 30 has the piezoelectric element holding portion 31 capable of hermetically covering the space, and the piezoelectric elements 300 are covered inside the piezoelectric element holding portion 31. Note that the size of the piezoelectric element holding portion 31 is formed so as to cover the plurality of aligned piezoelectric elements 300. Moreover, a reservoir portion 32 which constitutes at least part of the reservoir 100 is provided on the covering plate 30. In the present embodiment, this reservoir portion 32 is formed in a width direction of the pressure generating chambers 12, penetrating the covering plate 30 in its thickness direction. The reservoir portion 32 communicates with the communicating portion 13 of the passage-forming substrate 10 through a communicating hole provided on the elastic film 50, thereby constituting the reservoir 100, the common ink chamber for the pressure generating chambers 12. In addition, a penetrated hole 33, which penetrates the covering plate 30 in its thickness direction, is provided in a region between the piezoelectric element holding portion 31 and the reservoir portion 32 of the covering plate 30. The vicinities of the one set of ends of the lead electrodes 90, led out from the piezoelectric elements 300, are exposed at the penetrated hole 33. A material such as, for example, glass, a ceramic material, metal and resin can be employed to form the covering plate 30. Moreover, it is preferable to have substantially the same coefficient of thermal expansion of the passage-forming substrate 10. In the present embodiment, a single crystal silicon substrate, the same material used for the passage-forming substrate 10, is employed to form the covering plate 30.

Furthermore, a compliance plate 40 including a covering film 41 and a fixing plate 42 is joined with a region of the covering plate 30 corresponding to the reservoir portion 32. Herein, the sealing film 41 is made of a flexible material with low rigidity (e.g., a polyphenylene sulfide (PPS) film with a thickness of 6 μm) and seals one side of the reservoir portion 32. The fixing plate 42 is made of a hard material such as metal (e.g., stainless steel (SUS) with a thickness of 30 μm). Since a region of the fixing plate 42 facing the reservoir 100 is an opening portion 43 completely removed in a thickness direction of the fixing plate 42, the one side of the reservoir 100 is sealed by the flexible sealing film 41 alone.

Meanwhile, the nozzle plate 20 provided with the nozzle orifices 21 is fixed to the opening surface side of the passage-forming substrate 10 through an adhesive agent, a thermowelding film or the like. The nozzle orifices 21 are provided on the side of the nozzle plate 20 opposite the ink supply path 14 side to communicate with the ink supply paths 14 of the pressure generating chambers 12.

As described earlier, the region of the passage-forming substrate 10 facing the piezoelectric element holding portion 31 is relatively thicker than the outside of the region facing the piezoelectric element holding portion 31. More specifically, the central portion of the region of the passage-forming substrate 10 facing the piezoelectric element holding portion 31 is the thickest, and the passage-forming substrate 10 is tapered in thickness toward the peripheral portion of the region facing the piezoelectric element holding portion 31. In the present embodiment, the surface of the passage-forming substrate 10 at least in the region facing the piezoelectric element holding portion 31 is curved (substantially spherical), and almost the entire surface of the passage-forming substrate 10 is curved. The nozzle plate 20 is pressured and adhered to the surface of the passage-forming substrate 10, which is thus formed to be curved. In the present embodiment, a surface of the nozzle plate 20 is fixed while the surface thereof is curved (substantially spherical).

The nozzle plate 20 is made of glass ceramics or rust-proof steel, of which the thickness is, for example, 0.01 to 1 mm, and of which the linear expansion coefficient is 300° C. or less, for example, 2.5 to 4.5 ($\times 10^{-6}$/° C.). Moreover, one side of the nozzle plate 20 completely covers one side of the passage-forming substrate 10 to act as a reinforcing plate which protects the passage-forming substrate 10, the single crystal silicon substrate, from impact and external force. In addition, this nozzle plate 20 may be formed of a material having substantially the same coefficient of thermal expansion as that of the passage-forming substrate 10, such as a single crystal silicon substrate. In this case, the passage-forming substrate 10 and the nozzle plate 20 are deformed in substantially the same way by heat, and thus can be easily joined by use of a thermosetting adhesive agent or the like. The size of each pressure generating chamber 12 which gives ink droplet ejecting pressure to ink, and the size of each nozzle orifice 21 which ejects ink droplets are optimized according to an ejecting amount of the ink droplets, ejecting speed and ejecting frequency. For example, the nozzle orifices 21 need to be formed precisely with a diameter of several 10 s μm to record 360 ink droplets per inch.

The ink-jet recording head of the present embodiment takes in ink from external ink supply means (not shown). After the inside of the ink-jet recording head is filled with the ink from the reservoir 100 to the nozzle orifices 21, driving voltage is applied between the lower electrode film 60 and the upper electrode films 80, which correspond to the pressure generating chambers 12, according to driving signals sent from a drive IC (not shown). As a result, the elastic film 50, the lower electrode film 60 and the piezoelectric layers 70 increase the pressure in each pressure generating chamber 12, and thereby the nozzle orifices 21 eject ink droplets.

Figure 4A:
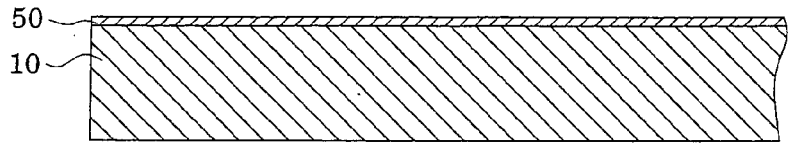
FIGS. 4A to 4D are sectional views showing a manufacturing process of the recording head according to Embodiment 1.
Figure 4B:
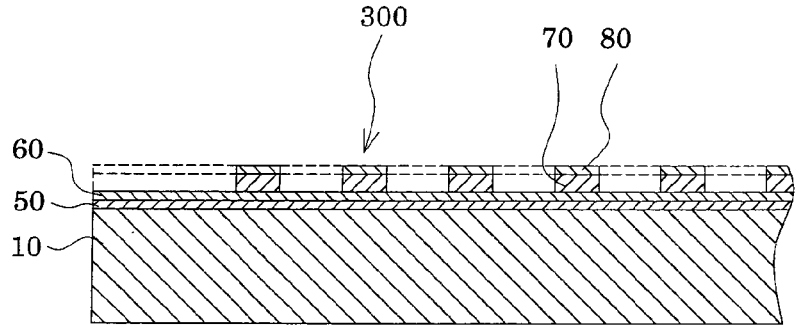
Figure 4C:
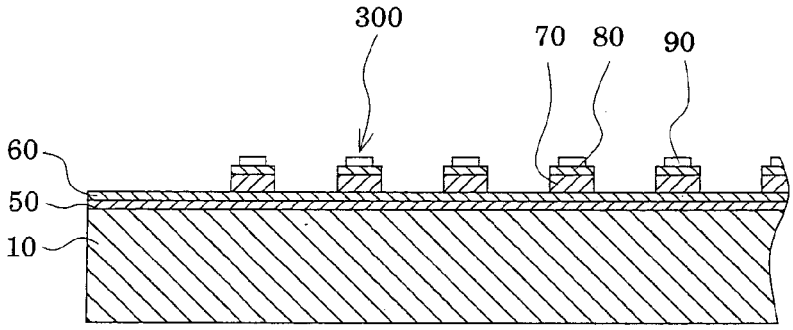

FIGS. 4A to 4D and FIGS. 5A to 5C are sectional views of the pressure generating chambers 12 in a width direction thereof. Hereinafter, a method of manufacturing the ink-jet recording head of the present embodiment will be described with reference to these drawings. First, as shown in FIG. 4A, a wafer of the single crystal silicon substrate, which becomes the passage-forming substrate 10, is subjected to thermal oxidation in a diffusion furnace at approximately 1100° C. to form the elastic film 50. Second, as shown in FIG. 4B, after the lower electrode film 60, made of platinum or the like, is formed on the elastic film 50, the lower electrode film 60 is patterned into a predetermined shape. Third, the piezoelectric layer 70 and the upper electrode film 80 are sequentially stacked and simultaneously patterned to form the piezoelectric elements 300. The piezoelectric layer 70 is made of, for example, lead zirconate titanate (PZT), and the upper electrode film 80 is made of many kinds of metal including aluminum, gold, nickel and platinum or conductive oxide and the like. Next, as shown in FIG. 4C, the lead electrodes 90 are formed. Specifically, for example, the lead electrode 90 made of gold (Au) and the like is formed over the entire area of the passage-forming substrate 10 and patterned for each piezoelectric element 300. Described hereinbefore is a film forming process.

Figure 4D:
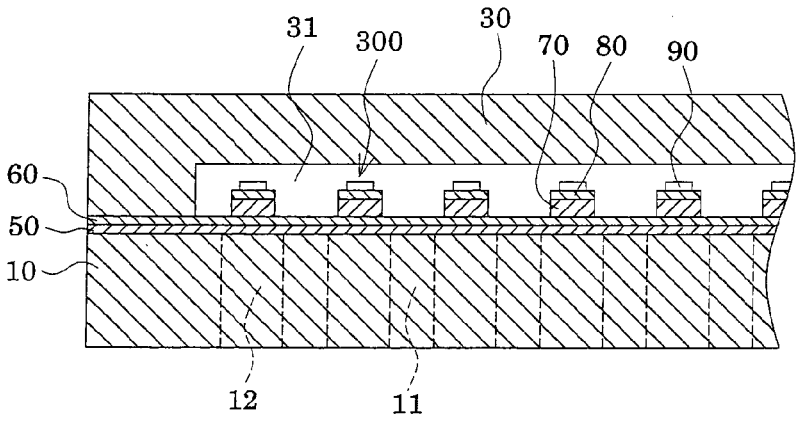

After thus forming the films, the anisotropic etching as described above is performed on the single crystal silicon substrate (passage-forming substrate 10) with the alkaline solution to form the pressure generating chambers 12, the communicating portion 13 and the ink supply paths 14. To be more specific, as shown in FIG. 4D, the piezoelectric element holding portion 31, the reservoir portion 32 and the like are pre-formed on the covering plate 30, and this covering plate 30 is joined with the side of the passage-forming substrate 10 where the piezoelectric elements 300 are provided. Since the piezoelectric element 300 formed inside the covering plate 30, the piezoelectric element 300 is hardly influenced by the external environment.

Figure 5A:
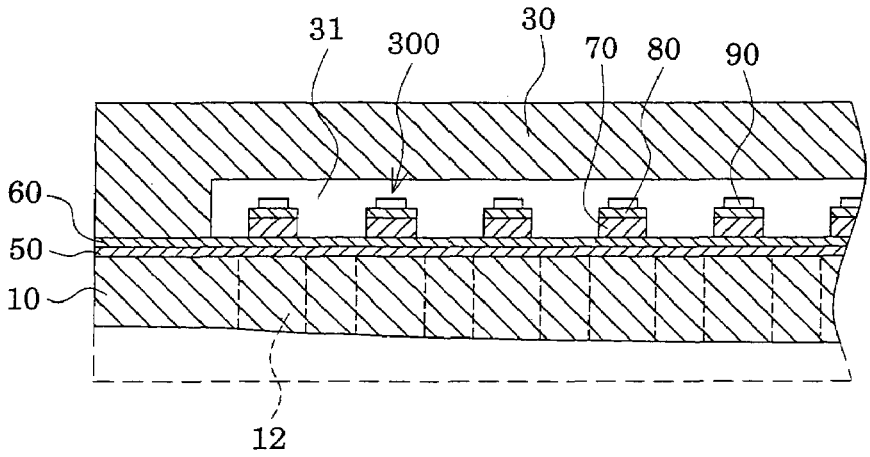
FIGS. 5A to 5C are sectional views showing the manufacturing process of the recording head according to Embodiment 1.

Subsequently, as shown in FIG. 5A, the surface of the passage-forming substrate 10 opposite the side where the piezoelectric elements 300 are provided, that is, the joint surface with the nozzle plate 20 is polished and ground, while being applied a predetermined load, to make the passage-forming substrate 10 have a predetermined thickness. At this time, by applying the predetermined load to the passage-forming substrate 10, the region of the passage-forming substrate 10 facing the piezoelectric element holding portion 31 becomes relatively thicker than the outside of the region facing the piezoelectric element holding portion 31. In other words, in the case where the surface of the passage-forming substrate 10 is polished or ground, the region of the passage-forming substrate 10 facing the piezoelectric element holding portion 31 is deformed toward the piezoelectric element holding portion 31 when the predetermined load is applied to the pressure-forming substrate 10. Accordingly, the amount removed by polishing or grinding in the region is smaller than that in other regions. By polishing or grinding the passage-forming substrate 10 until the vicinity of the edge of the passage-forming substrate 10 reaches the predetermined thickness, the surface of the passage-forming substrate 10 in the region facing the piezoelectric element holding portion 31 is formed substantially spherical. Thus, the region of the passage-forming substrate 10 facing the piezoelectric element holding portion 31 becomes relatively thicker than the outside of the region facing the piezoelectric element holding portion 31.

Figure 5B:
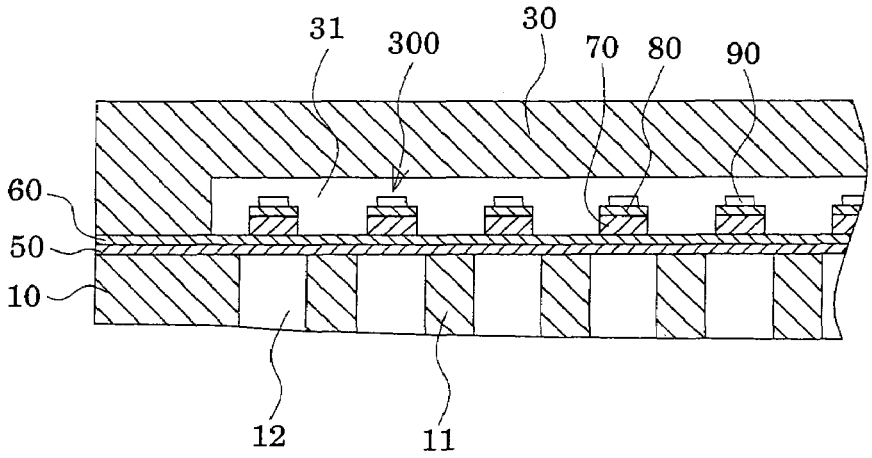
Figure 5C:
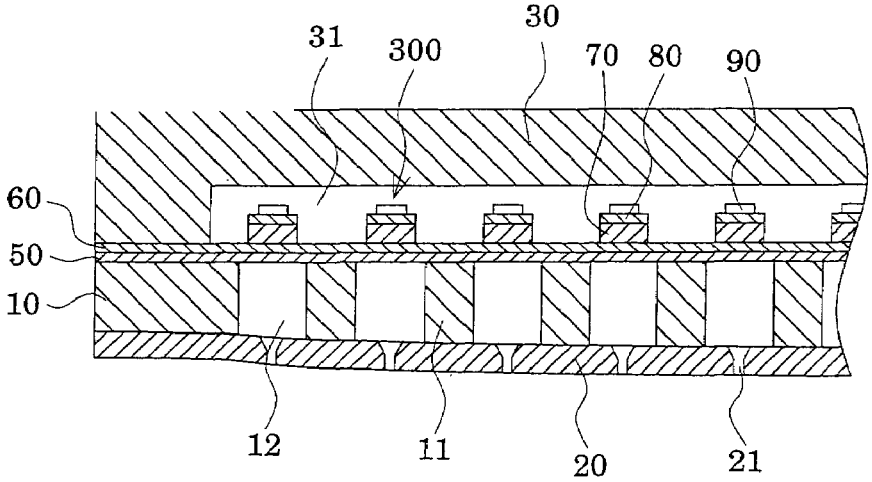

A difference in thickness between the central portion of the region of the passage forming substrate 10 facing the piezoelectric element holding portion 31 and the vicinity of the edge of the passage-forming substrate 10, that is, a difference between the maximum and minimum thicknesses of the passage-forming substrate 10 is preferably within a range from 30 nm to 5 μm. If the difference between the maximum and minimum thicknesses of the passage-forming substrate 10 is smaller than 30 nm, the passage-forming substrate 10 and the nozzle plate 20 cannot be suitably joined. If the difference exceeds 5 μm, ejection characteristics of the ink vary. Consequently, in the present embodiment, the thickness of the central portion of the region of the passage-forming substrate 10 facing the piezoelectric element holding portion 31 is set to approximately 70 μm, and the thickness of the vicinity of the edge of the passage-forming substrate 10 is set to approximately 67 μm. Note that the thickness of the passage-forming substrate 10 can be adjusted with relatively high precision by changing conditions such as an amount of the load in polishing or grinding the passage-forming substrate 10, Thereafter, as shown in FIG. 5B, the pressure generating chambers 12, the communicating portion 13, the ink supply paths 14 and the like are formed on the passage-forming substrate 10 by performing the aforementioned anisotropic etching with the alkaline solution. Note that the surface of the covering plate 30 is sealed when the anisotropic etching is performed. Next, as shown in FIG. 5C, the nozzle plate 20 provided with the nozzle orifices 21 is joined with the side of the passage-forming substrate 10 opposite the side where the covering plate 30 is joined. As described above, in the present embodiment, the region of the passage-forming substrate 10 facing the piezoelectric element holding portion 31 is relatively thicker than the outside of the region facing the piezoelectric element holding portion 31, and the rigidity of the passage-forming substrate 10 in the region facing the piezoelectric element holding portion 31 is relatively high. Therefore, the passage-forming substrate 10 is not deformed toward the piezoelectric element holding portion 31 by the load applied when the nozzle plate 20 is joined with the passage-forming substrate 10. Accordingly, it is possible to apply a substantially uniform load over the entire area of the nozzle plate 20 and to suitably join the nozzle plate 20 and the passage-forming substrate 10 together.

After the nozzle plate 20 is joined, the compliance plate 40 is joined with the covering plate 30 to constitute the ink-jet recording head of the present embodiment as shown in FIG. 1. Note that the aforementioned piezoelectric elements 300, the pressure generating chambers 12 and the like are actually formed on one wafer through the sequence of the film formation and anisotropic etching, and numerous chips are formed at once. In other words, as described above, after the film formation process is completed for the piezoelectric elements 300 or the like, the covering plate 30 is joined, and the pressure generating chambers 12 and the like are formed. Subsequently, the nozzle plate 20 and the compliance plate 40 are joined. Thereafter, the wafer is divided into the passage-forming substrates 10, each having one chip size as shown FIG. 1.

Figure 6:
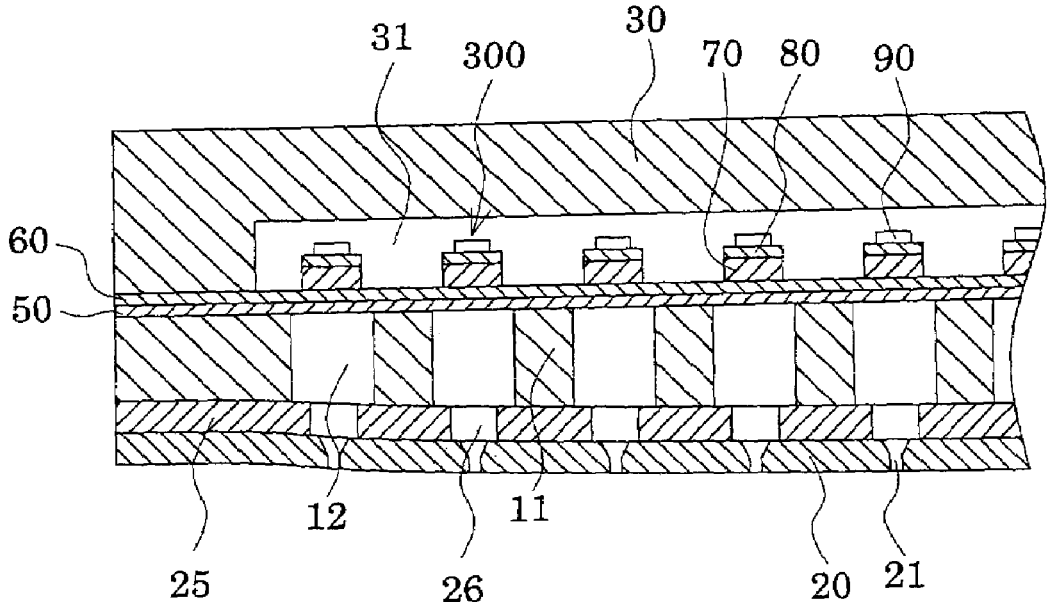
FIG. 6 is a sectional view showing a modification example of the recording head according to Embodiment 1.

Furthermore, the nozzle plate 20 is directly joined with the passage-forming substrate 10 in the present embodiment. However, the embodiment is not limited to this. For example, a nozzle communicating plate 25 may be provided between the passage-forming substrate 10 and the nozzle plate 20 as shown in FIG. 6. This nozzle communicating plate 25 is made of, for example, stainless steel (SUS) and has nozzle communicating holes 26 which make the pressure generating chambers 12 and the nozzle orifices 21 communicate. To be more specific, the nozzle communicating plate 25 may be joined with the passage-forming substrate 10, and the nozzle plate 20 may be joined with this nozzle communicating plate 25. The nozzle communicating plate 25 is also for protecting the passage-forming substrate 10 when a plurality of the passage-forming substrates 10 formed as a wafer is divided into pieces. In other words, by joining the nozzle plate 20 with the passage-forming substrate 10 through the nozzle communicating plate 25, the rigidity of the wafer, which becomes the plurality of passage-forming substrates 10, substantially increases. Therefore, it is possible to prevent the passage-forming substrate 10 from cracking when the wafer is cut into pieces to become the passage forming substrates 10.

OTHER EMBODIMENTS

Figure 7:
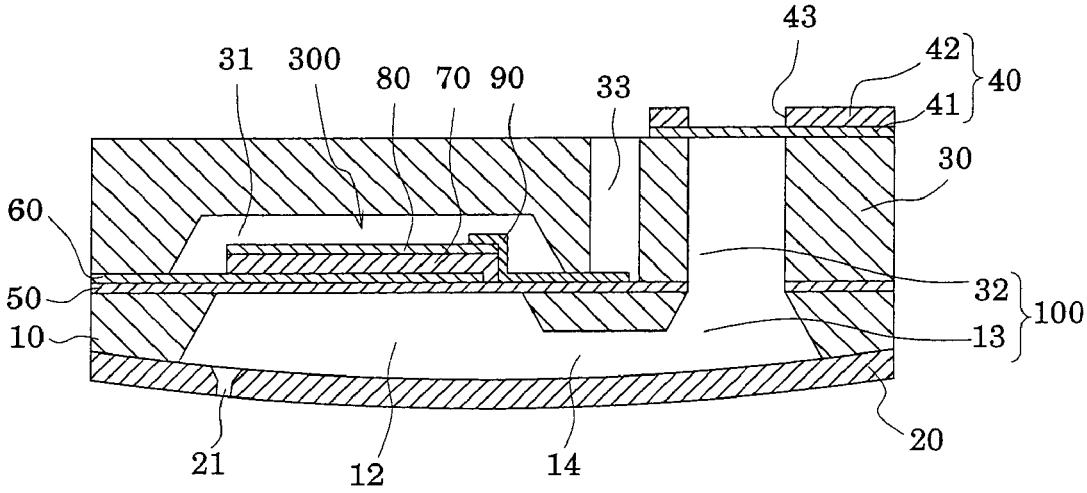
FIG. 7 is a sectional view of a recording head according to another embodiment.

The embodiment of the present invention has been hereinbefore described. However, as a matter of course, the present invention is not limited to the foregoing embodiment. For example, in the embodiment described above, the example has been described in which only the surface of the passage-forming substrate 10 in the region substantially facing the piezoelectric element holding portion 31 is polished to be curved (spherical). However, the shape of the surface of the passage-forming substrate 10 is not limited to this, and the entire joint surface of the passage-forming substrate 10 with the nozzle plate 20 may be curved as shown in FIG. 7, for example.

Moreover, for example, in the embodiment described above, the example has been described in which the joint surface of the passage-forming substrate 10 with the nozzle plate 20 is substantially spherical. However, the present invention is not limited to this. It is sufficient that the thickness of the passage-forming substrate 10 in the region facing the piezoelectric element holding portion 31 differs relatively in at least one direction of the longitudinal direction of the pressure generating chamber 12 and the aligned direction of the pressure generating chambers 12.

Further, for example, in the embodiment described above, the example has been described in which the final shape of the surface of the nozzle plate 20 is spherical. However, the shape of the surface of the nozzle plate 20 is not particularly limited. The surface of the nozzle plate 20 may be flat due to, for example, the bending of the entire ink-jet recording head.

Furthermore, for example, in the embodiment described above, the ink-jet recording head of a thin film type manufactured by utilizing the deposition and the lithography process has been taken as an example. However, the present invention is not limited to this, as a matter of course. For example, the present invention can be employed in the ink-jet recording head of a thick film type, which is formed by a method of attaching a green sheet or the like.

Figure 8:
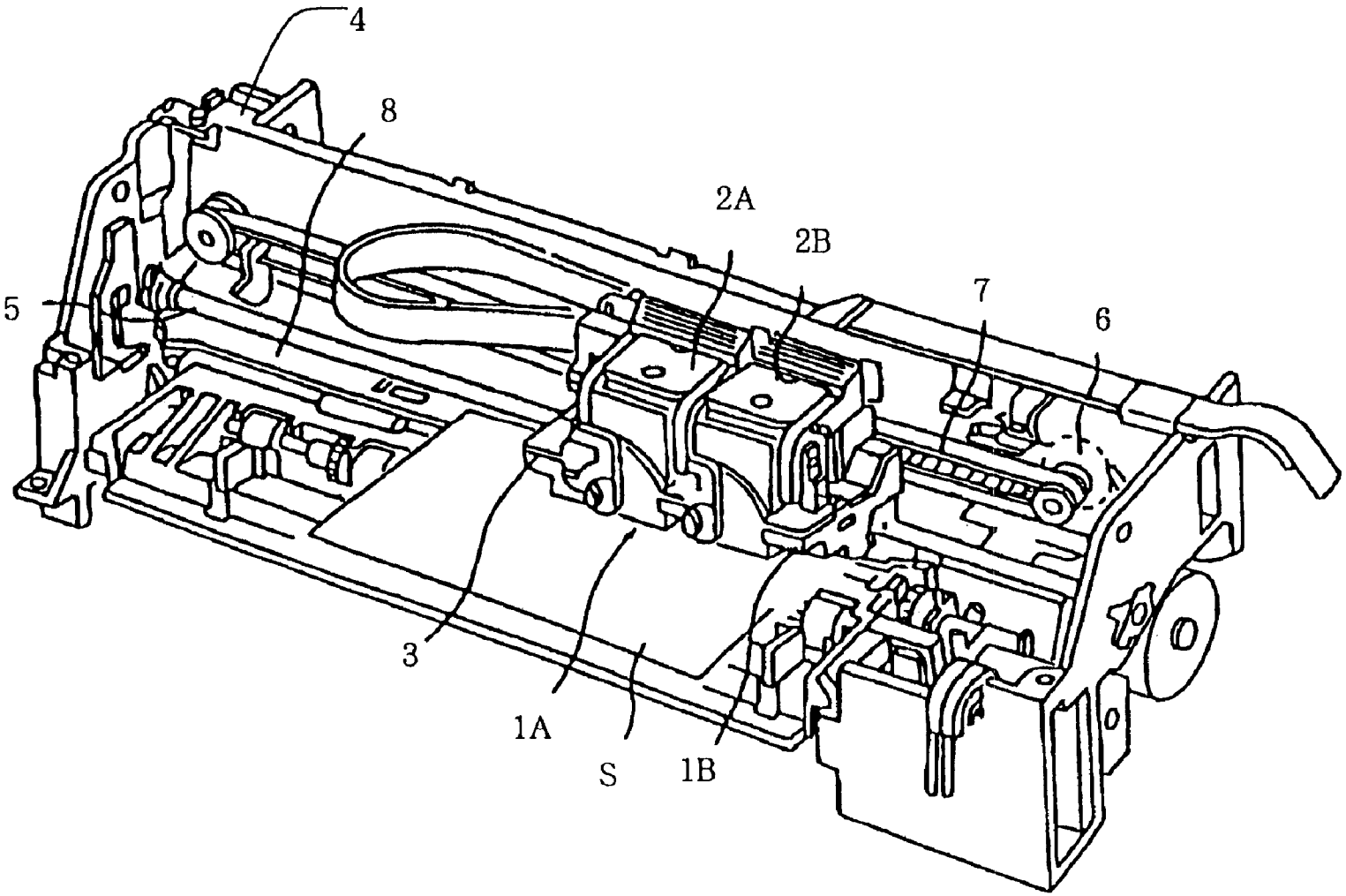
FIG. 8 is a schematic view of a recording apparatus according to an embodiment.

In addition, this ink-jet recording head constitutes part of a recording head unit which includes an ink passage communicating with an ink cartridge and the like and is installed in an ink-jet recording apparatus. FIG. 8 is a schematic view showing an example of the ink-jet recording apparatus. As shown in FIG. 8, cartridges 2A and 2B which constitute ink supply means are detachably provided to recording head units 1A and 1B having the ink-jet recording heads. A carriage 3 on which the recording head units 1A and 1B are installed is provided on a carriage shaft 5 attached to an apparatus main body 4 so as to be movable in an axial direction of the carriage shaft 5. These recording head units 1A and 1B eject, for example, a black ink composition and a color ink composition, respectively. Driving force of a drive motor 6 is transmitted to the carriage 3 through a plurality of gears (not shown) and a timing belt 7, thereby moving the carriage 3, on which the recording head units 1A and 1B are installed, along the carriage shaft 5. Meanwhile, a platen 8 is provided in the apparatus main body 4 along the carriage shaft 5, and a recording sheet S, which is a recording medium such as paper fed by a feeding roller (not shown) or the like, is conveyed onto the platen 8.

Note that the present invention targets a wide range of general liquid-jet heads and liquid-jet apparatuses, although the ink-jet recording head which ejects ink, as an example of the liquid-jet head, and the ink-jet recording apparatus have been described. Examples of the liquid-jet head include a recording head employed in an image recording apparatus such as a printer, a color material jet head used for manufacturing color filters of a liquid crystal display and the like, an electrode material jet head used for forming electrodes of an organic EL display, a field emission display (FED) and the like, and a bio-organic matter jet head used for manufacturing biochips.

What is claimed is:

1. A liquid-jet head including a passage-forming substrate on which pressure generating chambers communicating with nozzle orifices ejecting liquid are formed; and piezoelectric elements which are provided on one side of the passage-forming substrate through a vibration plate and cause pressure changes in the pressure generating chambers, wherein a covering plate having a piezoelectric element holding portion which covers the piezoelectric elements is joined with a surface of the passage-forming substrate where the piezoelectric elements are provided, and a nozzle plate provided with the nozzle orifices is joined with a surface of the passage-forming substrate opposite to the surface where the covering plate is joined, and a region of the passage-forming substrate facing the piezoelectric element holding portion is thicker than an outside region of the passage-forming substrate facing the piezoelectric element holding portion, when said piezoelectric elements are in a non-activated state.

2. The liquid-jet head according to claim 1, wherein the region of the passage-forming substrate facing the piezoelectric element holding portion is thicker than the outside of the region facing the piezoelectric element holding portion at least in an aligned direction of the pressure generating chambers.

3. The liquid-jet head according to claim 1, wherein the region of the passage-forming substrate facing the piezoelectric element holding portion is thicker than the outside of the region facing the piezoelectric element holding portion at least in a longitudinal direction of the pressure generating chambers.

4. The liquid-jet head according to claim 1, wherein the passage-forming substrate is tapered in thickness from the region facing the piezoelectric element holding portion to an edge of the passage-forming substrate.

5. The liquid-jet head according to claim 1, wherein a difference between a maximum thickness and a minimum thickness of the passage-forming substrate is 30 nm to 5 μm.

6. A liquid-jet apparatus comprising any one of the liquid-jet heads according to any one of claims 1 to 5.

* * * * *